US006694115B2

(12) United States Patent
Weaver

(10) Patent No.: US 6,694,115 B2
(45) Date of Patent: Feb. 17, 2004

(54) ALTERING PRINT CONFIGURATIONS FOR AUTHORIZED USERS

(75) Inventor: Jeffrey Scott Weaver, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 44 days.

(21) Appl. No.: 10/059,575

(22) Filed: Jan. 29, 2002

(65) Prior Publication Data

US 2003/0142990 A1 Jul. 31, 2003

(51) Int. Cl.[7] ..... G03G 15/00
(52) U.S. Cl. ..... 399/80
(58) Field of Search ..... 399/12, 13, 25, 399/79, 80, 182, 111, 42

(56) References Cited

U.S. PATENT DOCUMENTS 4,994,853 A * 2/1991 Fukuchi et al. ..... 399/12
5,250,984 A * 10/1993 Masai ..... 399/80
5,694,222 A * 12/1997 Yamada ..... 399/80 X
5,959,530 A * 9/1999 Lupien, Jr. et al. ..... 399/80 X
5,999,766 A * 12/1999 Hisatomi et al. ..... 399/80
6,188,851 B1 * 2/2001 Eom ..... 399/8
6,549,732 B2 * 4/2003 Yoshizaki et al. ..... 399/12

* cited by examiner

*Primary Examiner*—Hoan Tran

(57) ABSTRACT

Methods for altering configurations of printing devices are provided. A representative method includes: receiving information corresponding to an authorization of a user, the information including a designation of a first configuration of a printing device the user desires to enable; retrieving information adapted to enable the first configuration of the printing device; and enabling the printing device to exhibit the first configuration using the information retrieved. Systems, computer-readable media and other methods also are provided.

20 Claims, 8 Drawing Sheets

ALTERING PRINT CONFIGURATIONS FOR AUTHORIZED USERS

BACKGROUND OF THE INVENTION

1. Field of the Invention

The present invention generally relates to printing. In particular, the invention relates to systems and methods for selectively altering the configuration of a printing device.

2. Description of the Related Art

A printing device, such as a printer, typically is capable of exhibiting various attributes and/or features, the combination of which is known as a "configuration." The configuration of a printing device oftentimes is altered to accommodate user preferences and/or the requirements of a particular print task. For instance, some print tasks are adapted for duplex printing, where both sides of the pages are printed by the printing device. Duplex functionality, however, may not always be enabled by a printing device. By way of example, a user desiring a printing device to exhibit a configuration that includes duplexing, may be required to enable duplex functionality by manually configuring the printing device. Unfortunately, manually configuring a printing device can be labor intensive Additionally, in some environments, it may be beneficial to provide some users with access to a printing device that exhibits a particular configuration, while denying others such access. For example, it may not be desirable to provide some users with access to a particular print medium upon which a printing device is configured to print. On the other hand, it may not be practical to provide multiple printing devices, i.e., a printing device exhibiting the desired configuration for some of the users, and another printing device exhibiting the desired configuration of the others.

Based on the foregoing, it should be appreciated that there is a need for improved systems and methods which address these and/or other shortcomings of the prior art.

SUMMARY OF THE INVENTION

The present invention relates to altering configurations of printing devices. In this regard, a representative embodiment of a print system of the invention includes a printing device and a configuration-enabling system. The printing device includes a first print cartridge that contains a print substance for printing on a print medium and a readable identification tag for providing first information. An identification reader also is incorporated into the printing device. The identification reader is configured to receive the first information from the identification tag so that, if the first information does not correspond to the printing device, the identification reader enables the user to be informed that the print cartridge may not correspond to the printing device.

The configuration-enabling system communicates with the printing device and is configured to receive information corresponding to an authorization of a user. Preferably, the information includes a designation of a first configuration of the printing device that the user desires to enable. The configuration-enabling system also is configured to retrieve information that is adapted to enable the first configuration of the printing device. In this manner, the printing device can be enabled to exhibit the first configuration.

A representative embodiment of a method of the invention for altering a configuration of a printing device includes: receiving information corresponding to an authorization of a user, the information including a designation of a first configuration of the printing device the user desires to enable; and enabling the printing device to exhibit the first configuration in response to receiving the information.

A representative embodiment of a computer readable medium of the invention for use with a printing device includes: logic configured to receive information corresponding to an authorization of a user, the information including a designation of a first configuration of the printing device the user desires to enable; logic configured to retrieve information adapted to enable the first configuration of the printing device; and logic configured to enable the printing device to exhibit the first configuration by using the information retrieved.

BRIEF DESCRIPTION OF THE DRAWINGS

The present invention, as defined in the claims, can be better understood with reference to the following drawings. The drawings are not necessarily to scale, emphasis instead being placed on clearly illustrating the principles of the present invention.

DETAILED DESCRIPTION

As will be described in greater detail herein, systems and methods of the present invention potentially enable users to alter the configuration of printing devices. In particular, systems and methods of the invention can potentially enable one or more users to configure a printing device selectively. Preferably, selective altering of the configuration of a printing device is facilitated by the use of configuration-enabling information. In some embodiments, the configuration-enabling information is provided by a tag, which can be assigned to a user. As will be described in detail herein, once the configuration-enabling information has been provided, the printing device can access the information and enable and/or otherwise alter its configuration in response to the information.

Figure 1:
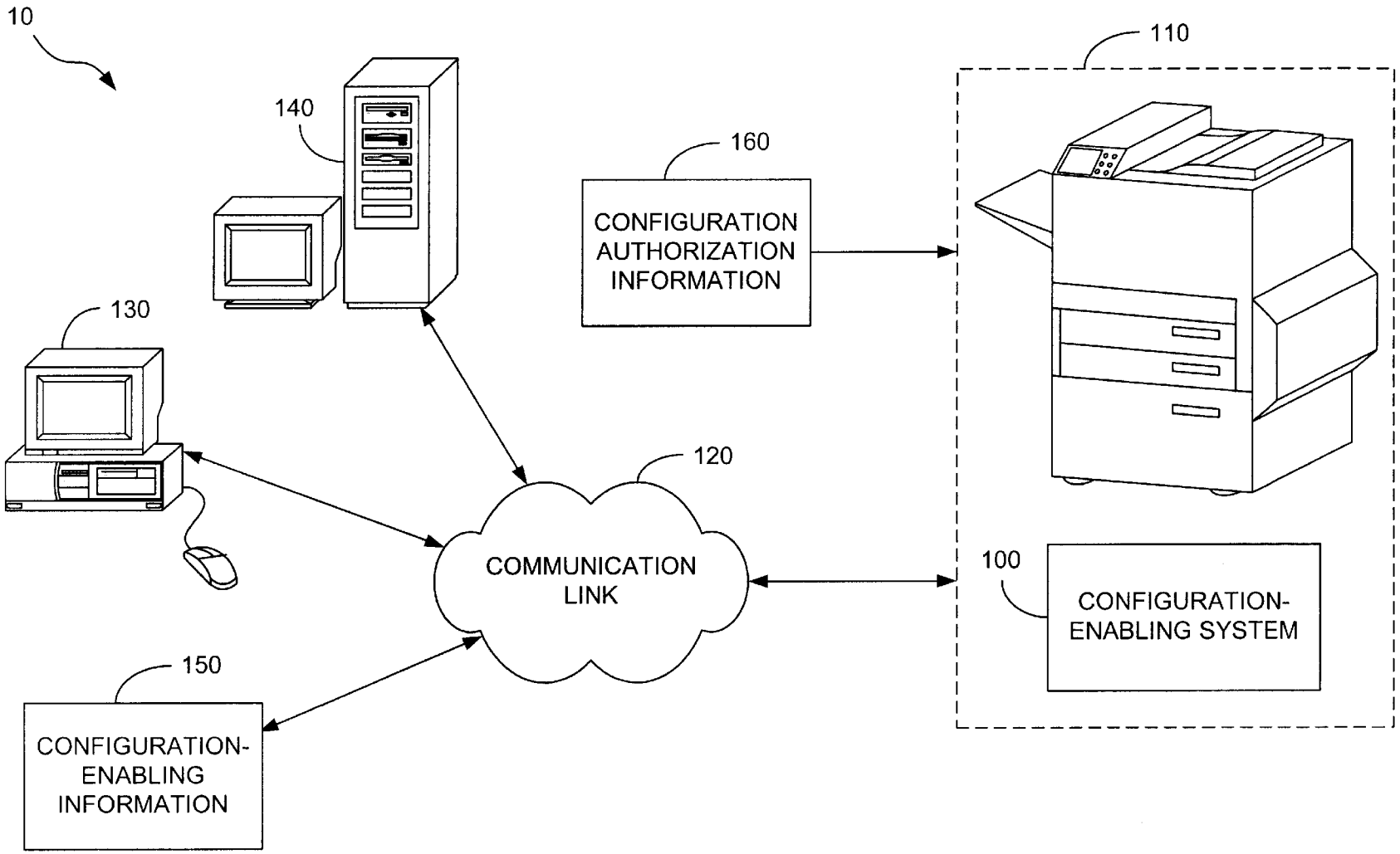
FIG. 1 is a schematic diagram depicting an embodiment of a print system of the present invention.

Reference will now be made to the drawings, wherein like reference numerals indicate corresponding components throughout the several views. As shown in FIG. 1, an embodiment of a print system 10 of the present invention can be implemented by a computer network. In FIG. 1, print system 10 includes a configuration-enabling system 100 that is associated with a printing device 110. As used herein, "printing device" refers to any device(s) that is able to receive information and convert the information to hard copy. By way of example, printers, facsimile machines and multi-function devices are printing devices. The computer network of FIG. 1 also includes a communication link 120 that enables various devices to communicate with the printing device. In particular, workstation 130, server 140 and configuration-enabling information 150 (described later) can communicate via the communication link.

Communication link 120 can include one or more of a direct link(s), e.g., a communication cable, and a network(s). Such a network can employ any network topology, transmission medium, or network protocol. For example, the network may be any public or private packet-switched or other data network, including circuit-switched networks, such as the public switched telephone network (PSTN), wireless network, or any other desired communications infrastructure and/or combination of infrastructures.

Also depicted in FIG. 1 is configuration authorization information 160. As will be described in greater detail herein, configuration authorization information 160 typically is associated with a user and is adapted to enable the user to alter a configuration of printing device 110. In particular, the configuration authorization information can interact with configuration-enabling system 100 so that the configuration-enabling system enables the printing device to exhibit characteristics desired by the user. By way of example, such characteristics could include duplex, copies, etc.

Figure 2:
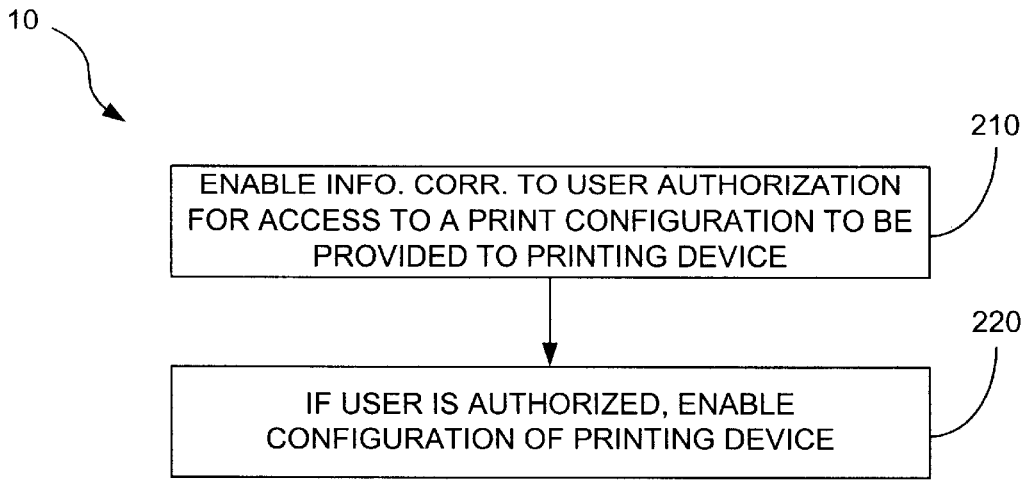
FIG. 2 is a flowchart depicting functionality of the embodiment of the print system of FIG. 1.

Functionality of the embodiment of print system 10 of FIG. 1 is depicted in the flowchart of FIG. 2. As shown in FIG. 2, print system or method 10 may be construed as beginning at block 210, where information corresponding to user authorization for access to a configuration of a printing device is enabled to be received. In some embodiments, the information corresponding to the user authorization is provided via a Radio Frequency Identification (RFID) tag, embodiments of which will be described later. In block 220, the printing device is enabled to exhibit a configuration that corresponds to the received information. In particular, if is determined that the user is authorized access to the configuration, the configuration can be enabled.

Figure 3:
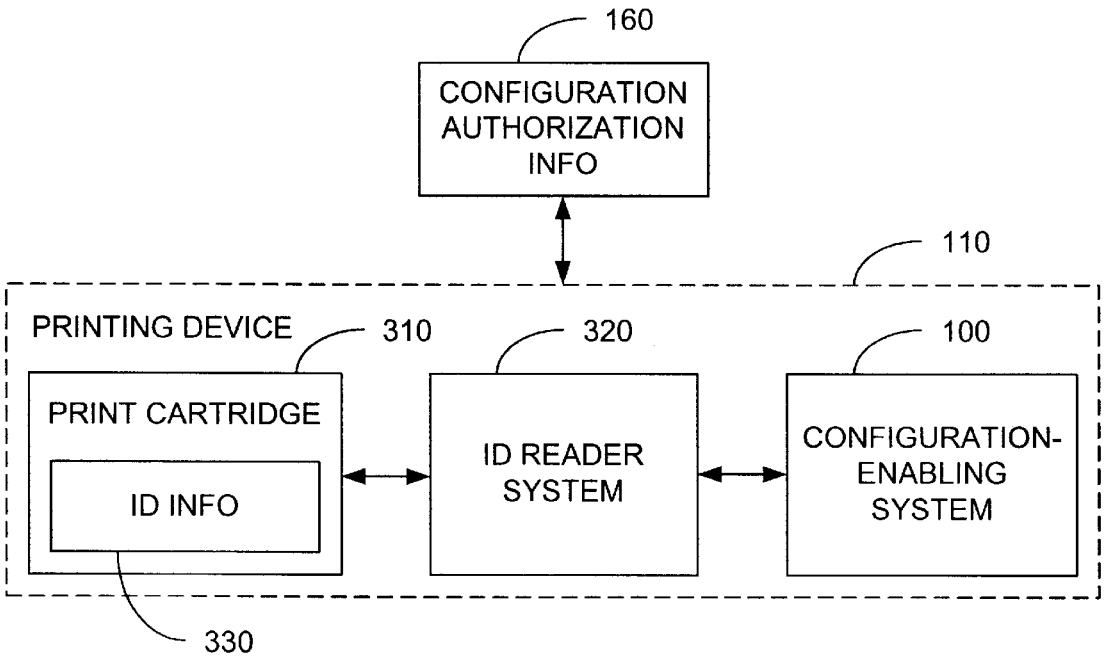
FIG. 3 is a schematic diagram of a printing device that can be used in a print system of the present invention, showing detail of an identification reader system interacting with identification information and configuration authorization information.

A representative printing device that can be used in print systems of the present invention will now be described with reference to the schematic diagram of FIG. 3. As shown in FIG. 3, printing device 110 includes a print cartridge 310 that contains a print substance, e.g., ink, toner, etc., for use by the printing device in performing a printing operation. Printing device 110 also includes an identification reader system 320 that is adapted to communicate with the print cartridge. In particular, although not required in all embodiments, the print cartridge can include identification information 330 that can be communicated to the identification reader system 320. The printing device preferably is configured to inform a user that the print cartridge may not correspond to the printing device unless the print cartridge installed in the printing device is able to communicate identification information to the identification reader system. In some embodiments, when the identification reader system detects the appropriate identification information from the print cartridge, e.g., the information corresponds to information stored by the printing device, additional print functionality of the printing device may be enabled.

As shown in FIG. 3, a configuration-enabling system 100 also can be included in the printing device. In such an embodiment, configuration-enabling system 100 preferably communicates with identification reader system 320. In particular, the identification reader system can be used to determine whether a user has provided appropriate information, e.g., configuration authorization information 160 provided by an RFID tag, to the printing device so that printing can be enabled with the associated configuration.

Figure 4:
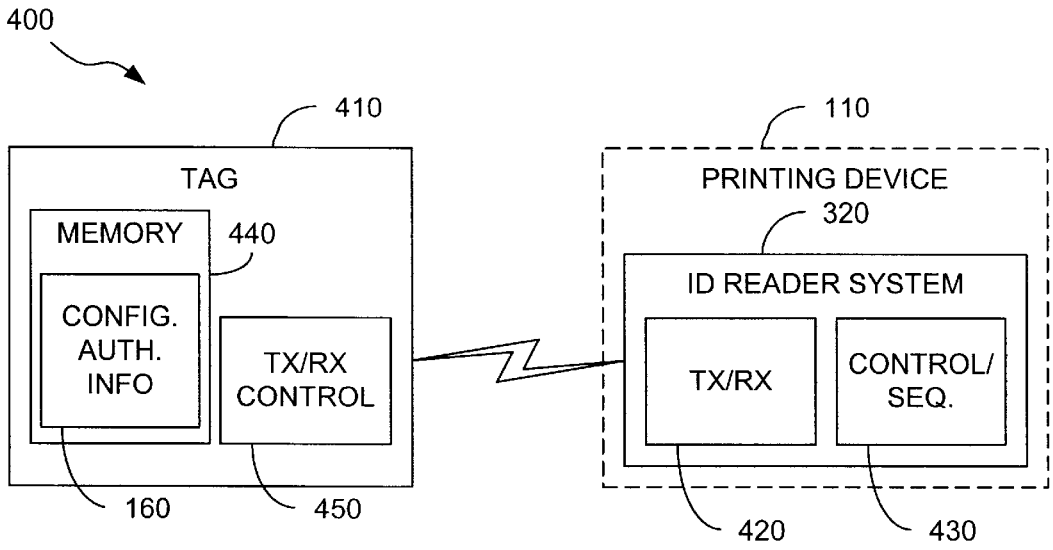
FIG. 4 is a schematic diagram depicting an embodiment of a radio frequency identification system that can be used in print systems of the present invention.

FIG. 4 is a schematic diagram depicting an embodiment of an identification tag/reader system 400 that can be used in print systems of the invention. As shown in FIG. 4, identification tag/reader system 400 includes an ID reader system 320 and a tag 410. Preferably, printing device 110 implements ID reader system 320, which includes a transmitter/receiver (Tx/Rx) 420 and a control/sequencer 430. Tx/Rx 420 modulates an RF carrier according to a selected protocol. The RF carrier is propagated by the Tx/Rx 420 and can be coupled to an antenna (not shown) of the tag 410. The tag rectifies the RF signal and uses the energy for powering various functions of the tag. For instance, the tag can store readable information in memory 440, e.g., non-volatile memory, and/or can retrieve data, such as configuration authorization information 160.

In order to provide data to the ID reader system, the tag typically uses load modulation, where a resistive load is switched across a power bus (not shown) of the tag. This causes a change in the loading of the antenna (not shown) of the tag, with the change in the loading being detectable by the ID reader system. Switching of a resistive load can be accomplished by Tx/Rx control 450. Depending upon the frequency used, the transmission range of data from a tag to an ID reader system can vary. For example, transmission ranges can vary from fractions of inches to several feet. Clearly, one of ordinary skill in the art should be able to select a suitable frequency based on the particular application.

Other functionality also can be provided by embodiments of the identification tag/reader system 400. By way of example, the ID reader system can be configured to determine whether multiple tags are within the reception range of the reader and/or whether multiple tags are attempting to respond to the reader simultaneously. Additionally, data to be stored within a tag may be encrypted prior to transmission. Challenge/response techniques also may be used.

Reference will now be made to the schematic diagram of FIG. 5, which depicts a representative embodiment of a printing device 110 that can be used to implement a configuration-enabling system 100. Note, configuration-enabling system 100 can be implemented in software, firmware, hardware, or a combination thereof. When implemented in hardware, configuration-enabling system 100 can be implemented with any or a combination of various technologies. By way of example, the following technologies, which are each well known in the art, can be used: a discrete logic circuit(s) having logic gates for implementing logic functions upon data signals, an application specific integrated circuit (ASIC) having appropriate combinational logic gates, a programmable gate array(s) (PGA), and a field programmable gate array (FPGA).

When implemented in software, configuration-enabling system 100 can be a program that is executable by a computer or processor-based device. For the purpose of the following discussion, printing device 110 is considered an example of such a computer or processor-based device.

Figure 5:
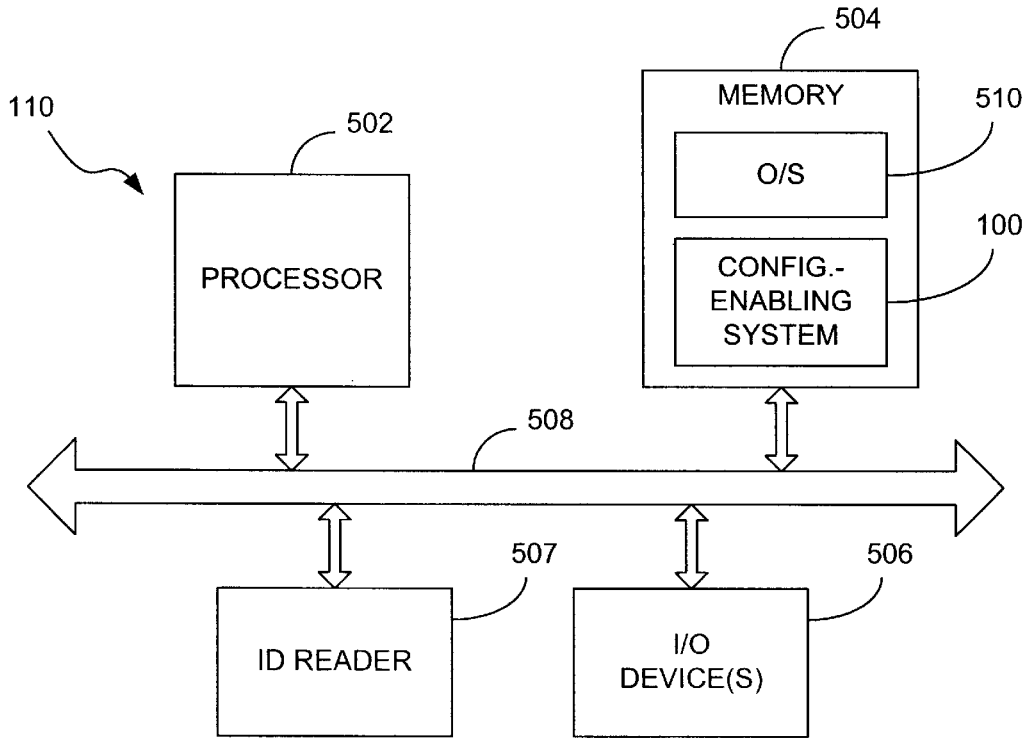
FIG. 5 is a schematic diagram depicting a computer or processor-based device that can be used to implement a configuration-enabling system of the present invention.

Generally, in terms of hardware architecture, printing device 110 of FIG. 5 includes a processor 502, memory 504, and one or more input and/or output (I/O) devices 506 (or peripherals) that are communicatively coupled via a local interface 508. Local interface 508 can be, for example, one or more buses or other wired or wireless connections, as is known in the art. Local interface 508 can include additional elements, which are omitted for ease of description. These additional elements can be controllers, buffers (caches), drivers, repeaters, and/or receivers, for example. Further, the local interface may include address, control, and/or data connections to enable appropriate communications among the components of printing device 110.

Processor 502 can be a hardware device configured to execute software that can be stored in memory 504. Processor 502 can be any custom made or commercially available processor, a central processing unit (CPU) or an auxiliary processor among several processors. Additionally, the processor can be a semiconductor-based microprocessor (in the form of a microchip), for example.

Memory 504 can include any combination of volatile memory elements (e.g., random access memory (RAM, such as DRAM, SRAM, etc.)) and/or nonvolatile memory elements (e.g., ROM, hard drive, tape, CDROM, etc.). Moreover, memory 504 can incorporate electronic, magnetic, optical, and/or other types of storage media. Note that memory 504 can have a distributed architecture, where various components are situated remote from one another, but can be accessed by processor 502.

The software in memory 504 can include one or more separate programs, each of which comprises an ordered listing of executable instructions for implementing logical functions. The software in the memory 504 includes configuration-enabling system 100 and a suitable operating system (O/S) 510. The operating system 510 controls the execution of other computer programs, such as configuration-enabling system 100. Operating system 510 also can provide scheduling, input-output control, file and data management, memory management, and communication control and related services.

The I/O device(s) 506 can include input devices, such as a keypad, for example. I/O device(s) 506 also can include output devices, such as a display device and printing mechanism(s), for example. I/O device(s) 506 may further include devices that are configured to communicate both inputs and outputs, such as a network communication port and ID reader system 507, for example.

When the printing device 110 is in operation, processor 502 is configured to execute software stored within the memory 504, communicate data to and from the memory 504, and generally control operations of the printing device 110. Configuration-enabling system 100 and the O/S 510, in whole or in part, are read by the processor 502, perhaps buffered within processor 502, and then executed.

When configuration-enabling system 100 is implemented in software, it should be noted that the configuration-enabling system can be stored on any computer readable medium for use by or in connection with any computer-related system or method. In the context of this document, a computer-readable medium is an electronic, magnetic, optical, or other physical device or means that can contain or store a computer program for use by or in connection with a computer-related system or method. Configuration-enabling system 100 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions.

As used herein, a "computer-readable medium" can be any means that can store, communicate, propagate or transport a program for use by or in connection with an instruction execution system, apparatus, or device. Thus, a computer readable medium can be, for example but not limited to, an electronic, magnetic, optical, electromagnetic, infrared, or semiconductor system, apparatus, device, or propagation medium. More specific examples (a nonexhaustive list) of a computer-readable medium include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical). Note that the computer-readable medium could even be paper or another suitable medium upon which the program is printed, as the program could be electronically captured, via optical scanning of the paper or other medium, then compiled, interpreted or otherwise processed in a suitable manner, if necessary, and then stored in a computer memory.

Reference will now be made to the flowchart of FIG. 6, which depicts the functionality of a representative embodiment of configuration-enabling system 100. In this regard, each block of the flowchart represents a module segment or portion of code that comprises one or more executable instructions, or logic for implementing the specified logical function(s). It should also be noted that in some alternative implementations the functions noted in various blocks of FIG. 6, or any other of the accompanying flowcharts, may occur out of the order in which they are depicted. For example, two blocks shown in succession in FIG. 6 may, in fact, be executed substantially concurrently. In other embodiments, the blocks may sometimes be executed in the reverse order depending upon the functionality involved.

Figure 6:
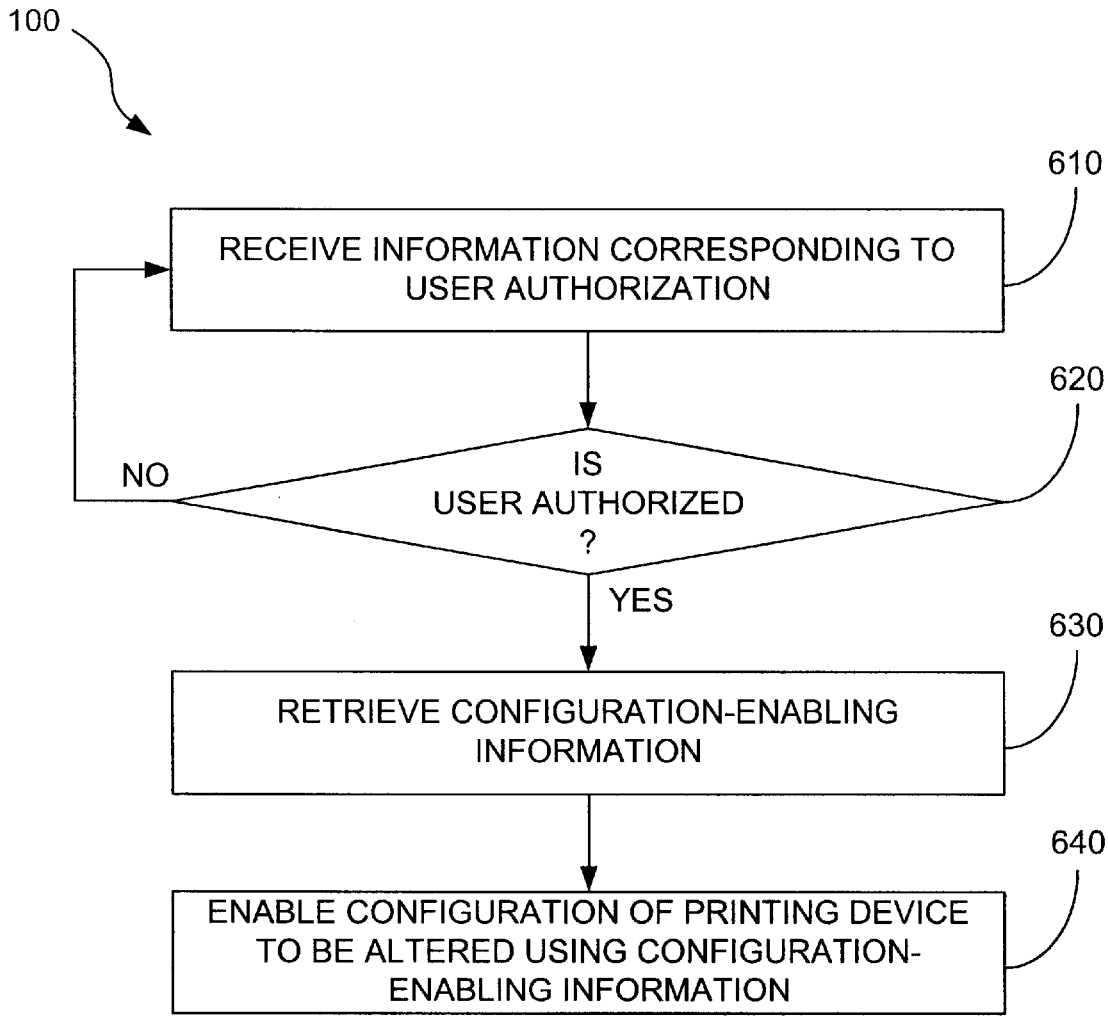
FIG. 6 is a flowchart depicting functionality of an embodiment of the configuration-enabling system of FIG. 5.

As shown in the flowchart of FIG. 6, the configuration-enabling system or method 100 may be construed as beginning at block 610, where information corresponding to user authorization is received. In particular, the information corresponds to whether the user is authorized to enable a particular configuration of the printing device. In block 620, a determination is made as to whether the user is authorized. If it is determined that the user is authorized, the process may proceed to block 630, where configuration-enabling information can be retrieved. More specifically, information that can be used to enable the configuration desired by the user can be located and accessed. In some embodiments, this can include accessing information available via a Web site and/or accessing information stored in memory associated with the printing device. In block 640, the user-desired configuration of the printing device is enabled using the configuration-enabling information. If, however, it is determined that the user is not authorized, the process may return to block 610.

By using a configuration-enabling system like that described above, a user may be able to activate a particular configuration of a printing device as desired. In particular, enabling of a configuration can be accomplished by providing the appropriate configuration authorization information to a printing device. In response to receiving the configuration authorization information, the configuration-enabling system of the printing device can activate the desired configuration. For instance, when the configuration authorization information is embodied in a tag, e.g., tag 410 of FIG. 4, the configuration of a printing device could be altered by placing the tag in proximity to the printing device.

Such tags could be provided by the manufacturer of a printing device, for example. In some embodiments, such a tag could be encoded with information corresponding to a predetermined printing device configuration. Additionally, some embodiments could be selectively encoded with information corresponding to the current printing device configuration preferences of a user. Therefore, if the preferences were to change, a tag could be re-encoded with information corresponding to another configuration.

In some embodiments, when a user desires a printing device to exhibit a configuration that includes operability of a particular feature, and that feature is not currently enabled, of the configuration-enabling systems of the invention could access information that can be used to enable the desire feature.

Figure 7:
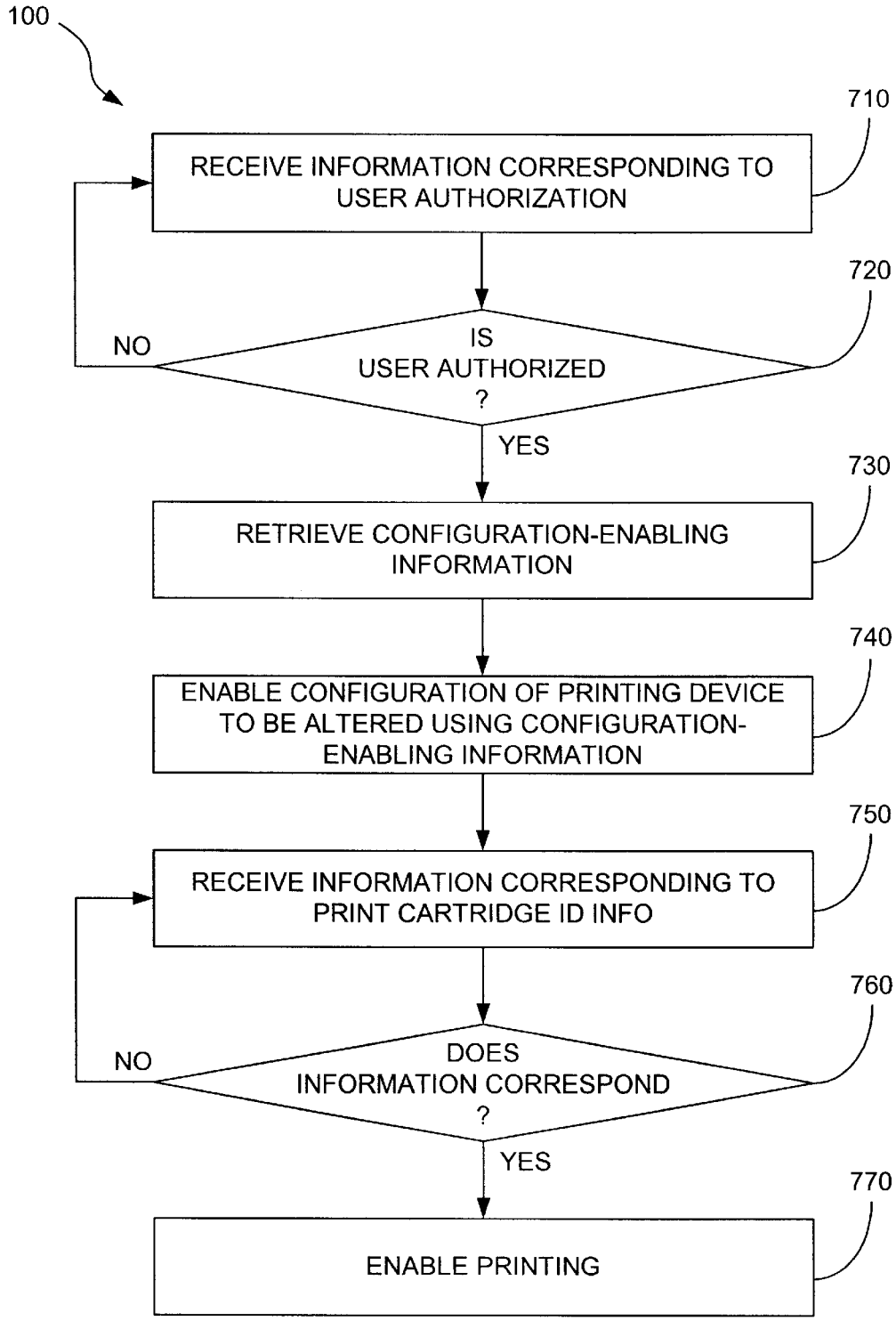
FIG. 7 is a flowchart depicting functionality of another embodiment of the configuration-enabling system of FIG. 5.

Reference will now be made to the schematic diagram of FIG. 7, which depicts another embodiment of a configuration-enabling system 100 of the present invention. As shown in FIG. 7, the configuration-enabling system or method 100 may be construed as beginning at block 710, where information corresponding to user authorization is received. In block 720, a determination is made as to whether the user is authorized access to a particular configuration. If it is determined that the user is authorized, the process may proceed to block 730, where configuration-enabling information is retrieved. More specifically, information that can be used to enable the configuration desired by the user is located and accessed. In some embodiments, this can include accessing information available via a Web site and/or accessing information stored in memory of the printing device. Note, when the configuration-enabling information is provided via a Web site or other location accessible via the Internet, the information corresponding to the user authorization can include a Uniform Resources Locator (URL) associated with the configuration-enabling information. The configuration-enabling system could then access the configuration-enabling information by using the URL. If, however, it is determined that the user is not authorized use of the configuration(s), the process may return to block 710. In block 740, the configuration of the printing device is enabled using the retrieved configuration-enabling information.

Proceeding to block 750, information corresponding to identification information of a print cartridge, e.g., information 330 of FIG. 3, of the printing device is received. In block 760, a determination is made as to whether the information associated with the print cartridge corresponds to the printing device. In some embodiments, this may include comparing identification information of the print cartridge to information stored by the printing device. If it is determined that the information correspond, the process may proceed to block 770, where printing is enabled. If, however, the information do not correspond, the process may return to block 750. Thus, when the information contained in the print cartridge does not correspond to the printing device, print functionality may be disabled. This can ensure that the print cartridge is authorized for use with the printing device.

Figure 8:
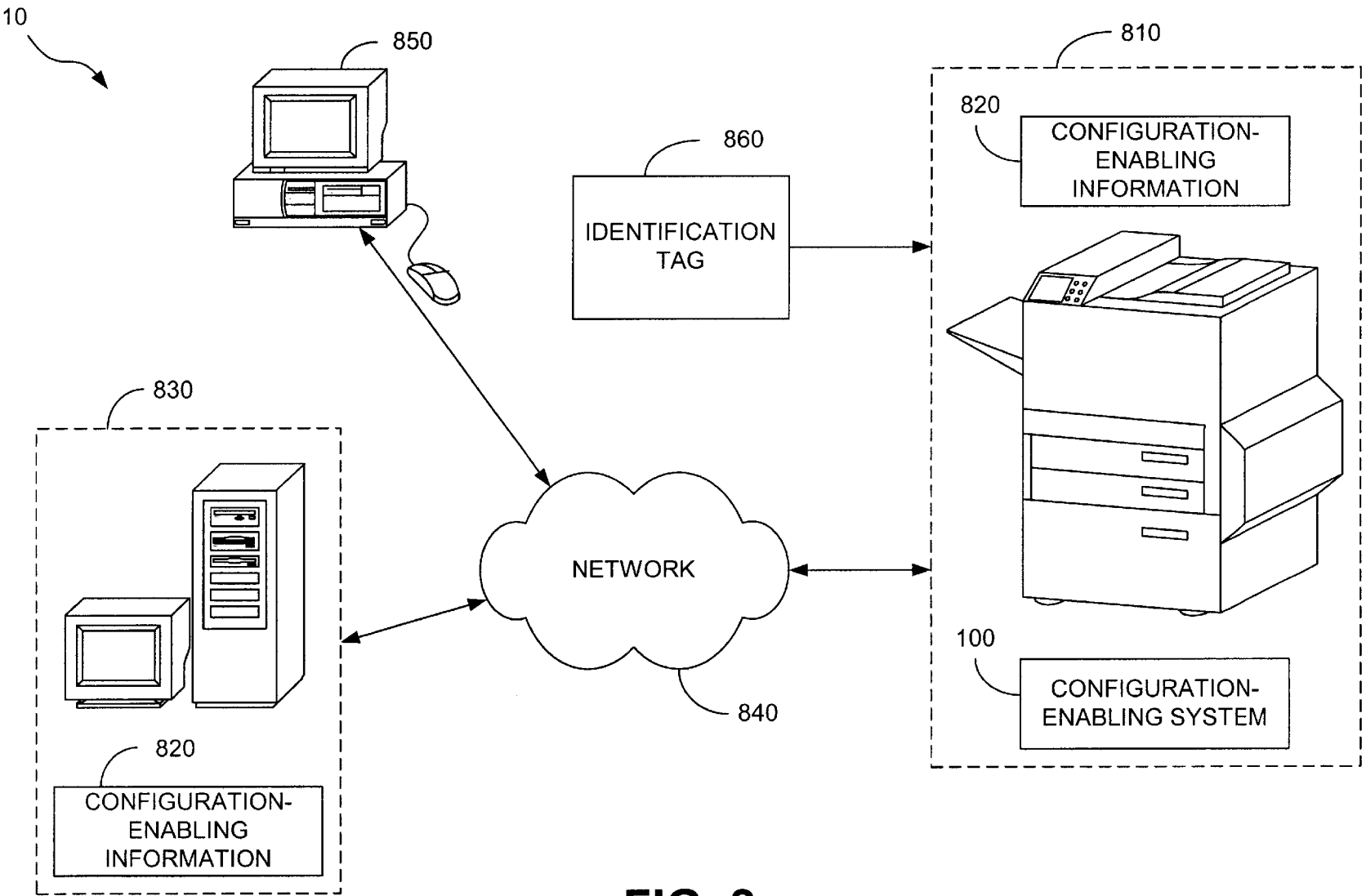
FIG. 8 is a schematic diagram depicting another embodiment of a print system of the present invention.

Reference will now be made to the schematic diagram of FIG. 8, which depicts another embodiment of a print system 10 of the present invention. As shown in FIG. 8, print system 10 includes a configuration-enabling system 800, which is associated with a printing device 810, as well as configuration-enabling information 820. Typically, the configuration-enabling information is associated with a device that is capable of providing information to the printing device. By way of example, the configuration-enabling information can be associated with a Web server, e.g., server 830, among others.

In FIG. 8, configuration-enabling system 100 communicates with the configuration-enabling information via a communication link 840. Various other devices also can communicate via the link, such as a workstation 850. Also depicted in FIG. 8 is an user authorization tag 860 that can indicate that the user is authorized access to a configuration as well as enable the configuration-enabling system to retrieve and/or access information for enabling the configuration.

Figure 9:
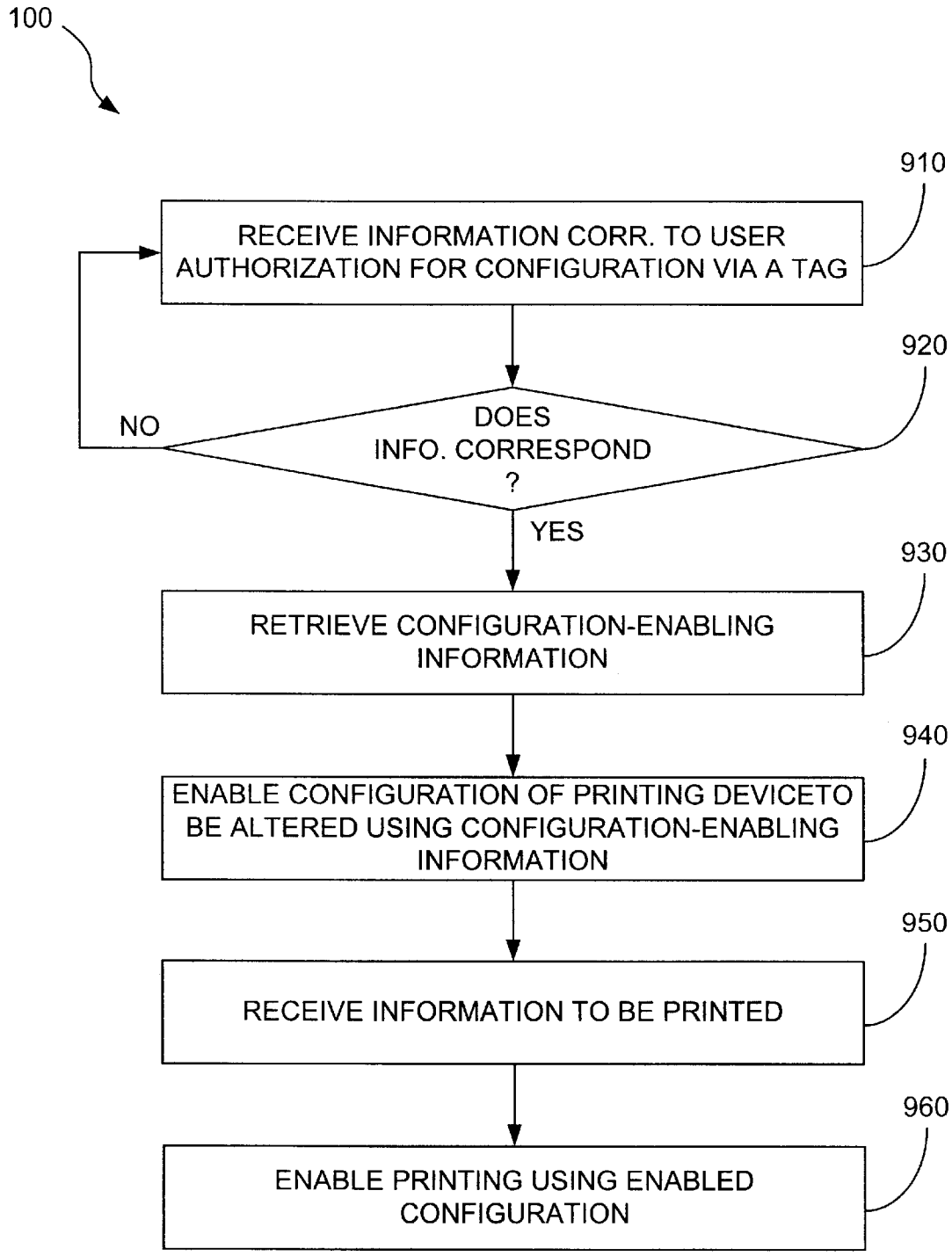
FIG. 9 is a flowchart depicting functionality of an embodiment of the configuration-enabling system of FIG. 8.

Functionality of the embodiment of the configuration-enabling system 100 of FIG. 8 will now be described with reference to the flowchart of FIG. 9. As shown in FIG. 9, the configuration-enabling system or method 100 may be construed as beginning at block 910, where information corresponding to user authorization pertaining to a printing device configuration is received via a user authorization tag. By way of example, such a tag could be purchased by a user and then placed in proximity to a printing device that is to be enabled with the configuration corresponding to the tag. Thus, when the user intends to enable a particular configuration, the user can acquire a tag associated with that configuration.

In some embodiments, an ID reader system associated with the printing system can be designed so that the tag can be placed near an outer surface of the printing device for reading. In other embodiments, the printing device can incorporate a slot, for example, into which the tag can be placed so as to provide the tag in close enough proximity to the reader system so that information can be received from the tag.

Proceeding to block 920, a determination may be made as to whether the information received via the tag corresponds to information associated with the printing device. In particular, a determination is made as to whether the tag is valid for use in enabling a configuration of the printing device. If is determined that the information contained in the tag corresponds, the process may proceed to block 930. In block 930, the printing device, or another device associated with the printing device, can retrieve information that is adapted to enable the desired configuration. Thereafter, such as depicted in block 940, the configuration can be enabled.

Proceeding to block 950, information to be printed can be received by the printing device. Thereafter, such as depicted in block 960, the information is enabled to be printed by the printing device using the enabled configuration. Note, in some embodiments, if it is determined that the tag is no longer communicating with the printing device, printing with the configuration associated with the tag(s) can be disabled.

Figure 10:
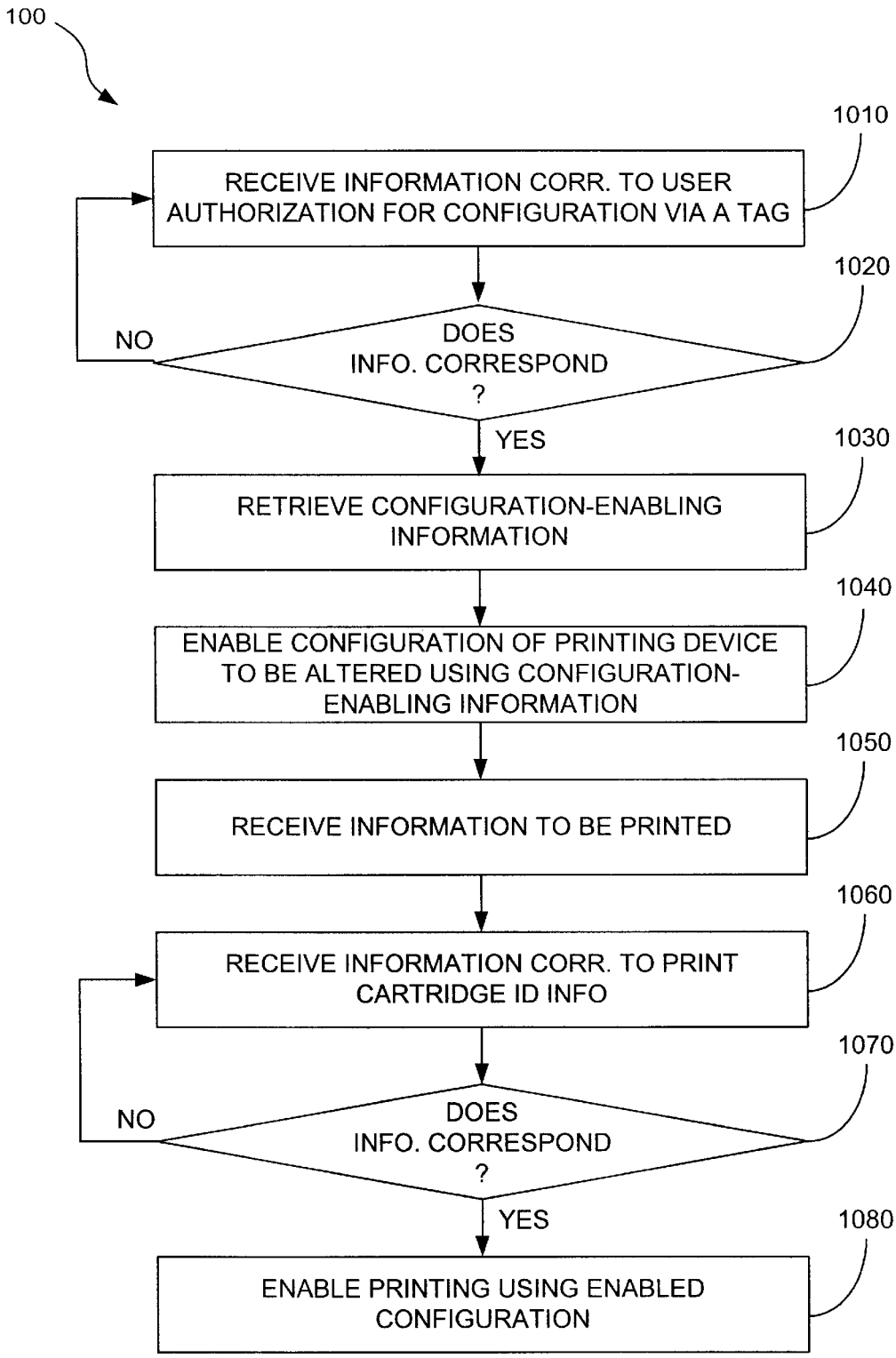
FIG. 10 is a flowchart depicting functionality of another embodiment of the configuration-enabling system of FIG. 8.

Functionality of another embodiment of the configuration-enabling system 100 will now be described with reference to the flowchart of FIG. 10. As shown in FIG. 10, the configuration-enabling system or method 100 may be construed as beginning at block 1010, where information corresponding to user authorization is received via an identification tag. In block 1020, a determination is made as to whether the information received via the tag corresponds to information associated with the printing device. If is determined that the information contained in the tag corresponds, the process may proceed to block 1030, where the printing device, or another device associated with the printing device, can retrieve information that is adapted to enable the configuration. Thereafter, such as depicted in block 1040, the configuration can be enabled.

Proceeding to block 1050, information to be printed can be received by the printing device. In block 1060, information corresponding to a print cartridge associated with the printing device is received. In block 1070, a determination may be made as to whether the information from the print cartridge corresponds with the printing device. If it is determined that the information does correspond, the process may proceed to block 1080, where the printing device is enabled to print using the enabled configuration. If, however, the information does not correspond, the process may return to block 1060. Thus, unless the print cartridge information corresponds, the printing device can be prevented from printing.

The foregoing description has been presented for purposes of illustration and description. It is not intended to be exhaustive or to limit the invention to the precise forms disclosed. Modifications and/or variations are possible in light of the above teachings. The embodiments discussed, however, were chosen and described to illustrate the principles of the invention and its practical application to thereby enable one of ordinary skill in the art to utilize the invention in various embodiments and with various modifications as are suited to the particular use contemplated. All such modifications and variations are within the scope of the invention as determined by the appended claims.

What is claimed is:

1. A method for altering a configuration of a printing device, said method comprising:

providing a user authorization tag comprising information corresponding to the authorization of the user, the information including a designation of a first configuration which the user desires the printing device to exhibit;

receiving, at the printing device, the information corresponding to the authorization of the user in response to the user authorization tag being in a proximity of the printing device; and altering the printing device to exhibit the first configuration in response to receiving the information from the user authorization tag.

2. The method of claim 1, further comprising:

accessing an external storage medium; and retrieving information adapted to enable the first configuration of the printing device from the external storage medium.

3. The method of claim 2, wherein the external storage medium is a Web server.

4. The method of claim 3, further comprising:

providing a Web site with the Web server.

5. The method of claim 1, further comprising:

receiving identification information corresponding to a print cartridge of the printing device;

determining whether the identification information corresponding to the print cartridge is associated with the printing device; and if the identification information corresponding to the print cartridge is not associated with the printing device, informing the user that the print cartridge may not correspond with the printing device.

6. The method of claim 1, further comprising:

retrieving information that is stored by the printing device and is adapted to enable the printing device to exhibit the first configuration.

7. The method of claim 1, further comprising:

receiving information to be printed; and enabling the printing device to print the information to be printed using the first configuration.

8. A print system comprising:

a printing device having a first print cartridge and an identification reader, the first print cartridge containing a print substance for printing on a print medium, the first cartridge having a readable identification tag for providing first information, the identification reader being configured to receive the first information from the identification tag, such that, if the first information corresponds to the printing device, the identification reader enables the printing device to print; and a configuration-enabling system communicating with the printing device, the configuration-enabling system being configured to:

receive information corresponding to an authorization of a user, the information including a designation of a first configuration of the printing device the user desires to enable, retrieve information adapted to enable the first configuration of the printing device, and enable the printing device to exhibit the first configuration; and a user authorization tag adapted to communicate with the identification reader via wireless communication, the user authorization tag including a memory, the memory storing the information corresponding to the authorization of the user;

wherein the identification reader includes a receiver, the receiver being adapted to receive the information corresponding to the authorization of the user via wireless communication;

wherein the user authorization tag includes information configured to enable the configuration-enabling system to retrieve the information adapted to enable the printing device to exhibit the first configuration.

9. The print system of claim 8, wherein the user authorization tag includes a Uniform Resources Locator corresponding to the information adapted to enable the first configuration of the printing device.

10. The print system of claim 8, further comprising:

a second print cartridge having an identification reader, the second print cartridge containing a print substance for printing on a print medium and a readable identification tag for providing the first information, the second print cartridge being adapted to be installed in the printing device after the first print cartridge is removed from the printing device.

11. The print system of claim 8, wherein the first configuration includes at least one of: Printer control language configuration, color management settings, and halftone screen settings.

12. The print system of claim 8, wherein the first configuration includes enabling user access to at least one of: a print medium, duplexing, and printing algorithm.

13. A computer readable medium for use with a printing device, said computer readable medium comprising:

logic configured to:

receive information corresponding to an authorization of a user, the information including a designation of a first configuration of the printing device, the information being provided by a user authorization tag that is placed, by the user, in proximity to the printing device, the user authorization tag including a designation of a first configuration that the user desires the printing device to exhibit;

retrieve information adapted to enable the first configuration of the printing device; and alter the printing device to exhibit the first configuration by using the information retrieved.

14. The computer readable medium of claim 13, further comprising:

logic configured to access a Web site; and logic configured to retrieve the information adapted to enable the first configuration from the Web site.

15. The computer readable medium of claim 13, further comprising:

logic configured to determine whether the information corresponding to the authorization of the user is being received; and logic configured to discontinue printing by the printing device using the first configuration if the information corresponding to the authorization of the user is not being received.

16. The computer readable medium of claim 13, wherein the logic configured to enable the printing device to exhibit the first configuration includes logic configured to access an external storage medium; and wherein the logic configured to retrieve the information adapted to enable the first configuration of the printing device is adapted to retrieve the information from an external storage medium.

17. The computer readable medium of claim 16, wherein the external storage medium is a Web server.

18. The computer readable medium of claim 13, further comprising:

logic configured to receive identification information corresponding to a print cartridge of the printing device;

logic configured to determine whether the identification information corresponding to the print cartridge is associated with the printing device; and logic configured to inform the user that the print cartridge may not correspond with the printing device if the identification information corresponding to the print cartridge is not associated with the printing device.

19. The computer readable medium of claim 13, wherein the logic configured to enable the printing device to exhibit the first configuration includes logic configured to access information stored by the printing device.

20. The computer readable medium of claim 13, further comprising:

logic configured to receive information to be printed; and logic configured to enable the printing device to print the information to be printed using the first configuration.

* * * * *